United States Patent [19]

Radtke et al.

[11] 4,359,108

[45] Nov. 16, 1982

[54] PNEUMATIC HAMMER HAVING A SAFETY DEVICE

[75] Inventors: Gerd Radtke; Klaus Heerde; Hans-Joachim Steiner; Klaus Mechelke, all of Berlin, German Democratic Rep.

[73] Assignee: VEB Werkzeugkombinat Schmalkalden, Schmalkalden, German Democratic Rep.

[21] Appl. No.: 136,035

[22] Filed: Mar. 31, 1980

[30] Foreign Application Priority Data

Apr. 24, 1979 [DD] German Democratic Rep. ... 212446

[51] Int. Cl.[3] ..... B25D 17/10

[52] U.S. Cl. ..... 173/15; 251/354

[58] Field of Search ..... 173/15, 18; 251/354

[56] References Cited

U.S. PATENT DOCUMENTS 1,380,118 5/1921 Sparrow ..... 173/18

2,899,934 8/1959 Salengro ..... 173/18

FOREIGN PATENT DOCUMENTS 397195 6/1924 Fed. Rep. of Germany ..... 173/18

*Primary Examiner*—Robert Mackey

*Attorney, Agent, or Firm*—Michael J. Striker

[57] ABSTRACT

A pneumatic hammer having a vibration attenuating hollow cylindrical member axially movable in a housing body, a striking piston axially movable within the cylindrical member, a stationary sealing sleeve engaging a portion of the outer surface of the cylindrical member, inlet air control means including an inlet passage in the wall of the cylindrical member, a slidable pressure ring cooperating with a pressure spring for urging the cylindrical member into a rest position in which the inlet air control means are disconnected from the inlet air channel and are connected instead to an outlet air channel in the housing body. Upon lifting the cylindrical member via a working tool, the passage to the outlet air channel is closed and the passage from the inlet air channel to the inlet air control means is opened and a normal operation of the hammer is initiated.

3 Claims, 1 Drawing Figure

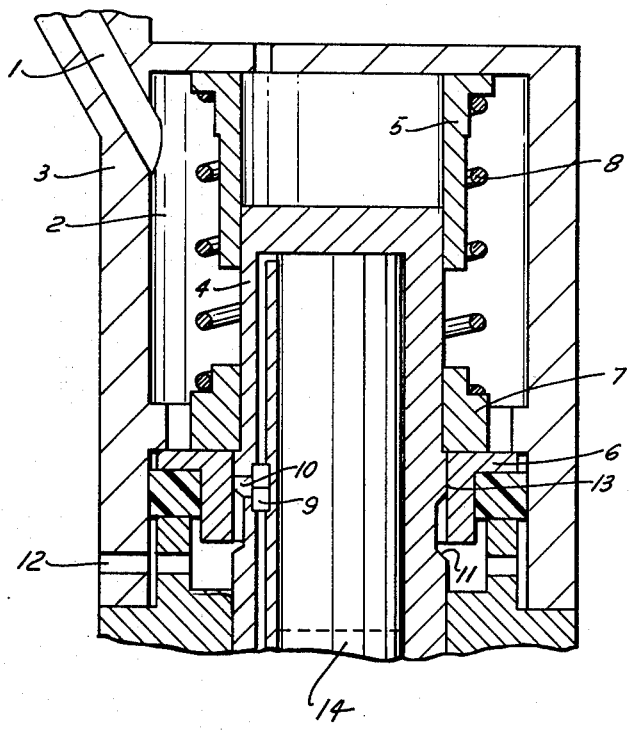
1
3
2
4
5
8
7
6
13
10
9
12
11
14

PNEUMATIC HAMMER HAVING A SAFETY DEVICE

BACKGROUND OF THE INVENTION

This invention relates generally to pneumatic hammers and in particular it relates to a hammer of the type having a housing body defining an inlet air channel and an exhaust air channel, a hollow cylindrical member guided for a reciprocating axial movement within the body and a striking piston guided for a reciprocating axial movement within the cylindrical member.

In pneumatic hammers of this type, the arrangement of the reciprocating striking piston in a hollow cylindrical member which is guided for a reciprocating axial movement in the hammer housing brings about that vibrations resulting during the operation of the hammer are attenuated. The damping of vibrations of the hammer substantially improves the working conditions of the operator who no longer is exposed to excessive percussions which are hazardous to the operator's health.

The disadvantage of prior art structures of pneumatic hammers having means for damping vibrations is the fact that due to the axial freedom of movement of the hollow cylindrical member in the housing body, the hammer can be set into operation even if a work tool inserted into the cylindrical member is not in an effective contact with the working surface.

This undesired possibility results from the fact that upon actuation of the inlet valve, the pressure air starts flowing into the working hollow cylinder and sets the striking piston into motion. This condition, however, brings about a considerable chance of accidents inasmuch as the working tool which is insufficiently ensured against expulsion from the hammer can be pushed out and in addition during the idling operation of the hammer an unnecessary high wear of the pneumatic hammer takes place.

The above-described disadvantages of prior art structures of vibration attenuated pneumatic hammers have therefore the consequence that the attending personnel has to exert a high degree of precaution in order to prevent working accidents due to an unintended expulsion of the working tool from the housing body and to avoid the unnecessary mechanical wear of the hammer in the range of the mounting device for the insertable working tool.

In order to reduce the above-described disadvantages, safety means have been already devised in the vibration attenuated pneumatic hammers of this type. In such known safety devices, the axial displacement of the working hollow cylinder relative to the housing body of the hammer is utilized for controlling the inlet of the pressure air into the working hollow cylinder. For example, in the German utility model No. 72 11 456, a solution is known where entry of the pressure air into the interior of the working hollow cylinder when the latter is in its rest position is prevented by providing an air exit opening on a guiding pin on which the working hollow cylinder is axially movable relative to the housing body whereby in the rest position of the hollow cylinder, this exit opening is closed.

The disadvantage of this prior art solution for controlling the discharge of the pressure air into the working hollow cylinder is the fact that component parts for controlling the discharge of the pressure air are off-set from the center of the working cylinder and consequently are exposed to a relatively high wear. This wear in turn causes a relatively fast deterioration of the seal of the control channels and consequently the operational disturbances of the hammer itself. Moreover, in the rest position of the working hollow cylinder, it cannot be excluded that due to the deteriorated sealing surfaces of respective component parts of the hammer, pressure air in the form of a driving airstream at the open inlet valve and in the form of a leaking stream at the closed inlet valve, will enter the interior of the working hollow cylinder. As a result, the striking piston of the pneumatic hammer is set into operation in an uncontrollable manner and performs so-called unloaded blows. The striking energy of such unloaded blows and the tool mounted in the hammer housing encounters no resistance against a working surface and has a negative influence on the working life of the hammer. Apart from the previously discussed danger of expulsion of the insufficiently secured working tool in the hammer housing during the empty or unloaded blows and resulting danger of injury of bystanders, the arresting device for the working tool, the so-called tool lock becomes exposed to excessive blows of the free striking piston and may become so damaged that its function is impaired. In other words, apart from the disadvantageous effects relating to the insufficient operational safety, the occurrence of free-running or unloaded blows may cause also a momentary or permanent inoperativeness of the entire pneumatic hammer.

SUMMARY OF THE INVENTION

It is therefore a general object of the present invention to overcome the aforementioned disadvantages.

More particularly, it is an object of the invention to provide a safety device in a pneumatic hammer having an axially movable hollow cylindrical member for damping vibrations in which the operation of the hammer can be initiated only upon the establishment of an effective contact of the work tool inserted in the hollow cylinder so that the occurrence of free running blows of the work tool is effectively prevented.

More particularly, an object of this invention is to provide such an improved safety device which ensures that no driving pressure air can enter the interior of the hollow cylindrical member prior to the contact of the work tool with the workpiece even if the air inlet valve is open.

Another object of this invention is to ensure that no leakage air can enter the interior of the hollow working cylinder when the air inlet valve is closed.

In keeping with these objects and others which will become apparent hereafter, one feature of the invention resides, in a pneumatic hammer of the aforedescribed type, in the provision of inlet air control means in the wall of the hollow working cylinder, a stationary sleeve sealingly surrounding a surface portion of the cylindrical member between the inlet and exhaust air channels of the hammer body, and means for biasing the hollow working cylinder into an initial position in which the inlet air control means is closed by the sleeve.

According to another feature of this invention, a movable guiding sleeve surrounds the hollow working cylinder and in the rest or initial position of the latter closes the inlet air control means.

Another feature of this invention resides in the fact that the inlet air control means include an annular recess provided in the upper surface portion of the hollow working cylinder and a control valve communicating with the interior of the hollow working cylinder via pressure distributing passages and with the annular recess. In order to fulfill the object of this invention, the annular recess in the initial position of the hammer is completely covered by the sealing sleeve and the stationary portion of the sleeve is provided with radial passages permitting the discharge of the exhaust air.

The advantage of the solution according to this invention is an improved overall construction of control means for the driving air stream necessary for starting the operation of the pneumatic hammer and the improvement of the form of the control means which is more advantageous from the point of view of manufacturing technology and also for improving the functional reliability. In contrast to known safety devices in pneumatic hammers which prevent free running blows only when the control valve for pressure air is open, but cannot prevent the free running blows caused by leaking air at a closed control valve, the safety device of this invention prevents the occurrence of free running blows at ready-to-operate pneumatic hammers both at the open and at the closed air inlet control valve.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The single FIGURE is a sectional axial view of a cutaway portion of a pneumatic hammer having a housing body and a reciprocable hollow cylindrical member guided in the body.

DESCRIPTION OF THE PREFERRED EMBODIMENT

The drawing illustrates only the part of the pneumatic hammer which is relevant to the safety device of this invention. Conventional parts such as a handgrip of the hammer including an air inlet, inlet valve and a control lever for the inlet valve has been omitted and only a part of the housing body 3 together with an inlet air channel 1 downstream of the inlet valve is illustrated. A hollow working cylinder 4 is guided in the housing body for a reciprocating movement and its upper part is guided in a guiding sleeve 5 which defines with the inner wall of the housing body 3 an annular chamber 2 communicating with the air channel 1. The working cylinder 4 is constructed in a conventional manner for cooperation with a striking piston 14. A lower section of the outer surface of the working cylinder 4 is slightly increased in diameter and the resulting step supports a pressure ring 7. A sealing sleeve 6 has a top flange abutting against a step in the inner wall of the housing body 3. The inner wall of the sleeve 6 tightly surrounds the increased outer surface of the working cylinder 4. A spiral spring 8 is provided between the pressure ring 7 and the footing of the guiding sleeve 5 to urge the cylinder 4 in its initial or rest position as illustrated in the drawing.

In this rest position, the bottom of the pressure ring 7 abuts against the top of the sealing sleeve 6 and interrupts the communication between the annular chamber 2 and the air inlet 10 in the wall of the working cylinder 4. As a consequence, even if the nonillustrated air inlet valve is opened and pressure air enters the annular chamber 2, it cannot reach via the air inlet 10 the interior of the cylinder 4. Only upon axially displacing upwardly the working cylinder 4 together with the pressure ring 7 by placing a working tool which is secured to a nonillustrated lower part of the working cylinder 4, in contact with the surface of a workpiece, the radially directed air inlet 10 is displaced above the upper surface of the sealing sleeve 6 and is connected to the pressure air in the annular chamber 2. The stream of pressure air from chamber 2 now opens control valve 9 in the wall of the cylinder 4 and starts in a conventional manner the operation of the pneumatic hammer. The function of valve 9 is to control the strokes of piston 14 in a manner which is well known in the art and need not be described in detail.

If the effective contact between the working tool and the working surface is interrupted, pressure spring 8 returns the working cylinder 4 into its initial position in which the pressure ring 7 closes the passage between the inlet 10 and the chamber 2 and the pneumatic hammer is immediately deenergized.

As it has been described before, any play which may occur between the surfaces of the sealing sleeve 6 and the upper surface of the working cylinder 4 may cause a penetration of pressure air into the inlet 10 both at the closed and the open condition of the main control valve in the handgrip of the hammer and is driving or leaking pressure air by actuating the control valve 9 in the working cylinder 4 and thus producing an unintended actuation of the hammer. The resulting free running blows as it has been explained above considerably impair the safety of operation of the hammer.

In order to completely remove the danger of such free running blows, an annular recess 11 is formed in the upper surface of the enlarged portion of the working cylinder 4 which communicates with the air inlet 10 and exceeds the axial extension of the sealing sleeve 6 so as to permit the escape of the penetrated air through radially extending relief openings 12 extending radially in the wall of the housing body 3 to discharge any air penetrated into the air inlet 10 into the outer atmosphere. The provision of this safety increasing annular recess 11 in the outer wall of the working cylinder 4 prevents any pressure build-up in the area of the air inlet 10 and thus prevents the actuation of the control valve 9 and any flow of the pressure air in the interior of the working cylinder 4. The width of the annular recess 11 is dimensioned such that upon lifting the cylinder 4 relative to the housing body 3, the lower edge of the recess 11 is covered by the lower edge of the sleeve 6 and consequently the passage between the air inlet 10 and the air outlet 12 is closed and the normal operation of the hammer takes place in the same manner as described above.

It will be understood that each of the elements described above, or two or more together, may also find a useful application in other types of constructions differing from the types described above.

While the invention has been illustrated and described as embodied in a specific example of a pneumatic hammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitutes essential characteristics of the generic or specific aspects of this invention.

We claim:

1. A pneumatic hammer comprising a housing body defining an inlet air channel and an outlet air channel; a hollow cylindrical member guided for a reciprocating axial movement within said body, one end of said member being adapted for holding a work tool; a striking piston guided for a reciprocating axial movement within said cylindrical member; air control means provided in a wall of said cylindrical member and communicating with the interior of said cylindrical member to control the strokes of said piston, said air control means including an air inlet-and-discharge opening in a cylindrical surface portion of said cylindrical member between said inlet and outlet air channels; a safety device including a recess formed in said surface portion of the cylindrical member in the range of said air inlet-and-discharge opening, a stationary sleeve exceeding in length said recess and sealingly engaging said cylindrical member, and means for biasing said cylindrical member into an initial position in which said sleeve closes the connection between said inlet air channel and said recess and opens the connection between said outlet air channel and said recess.

2. A pneumatic hammer as defined in claim 1, wherein said biasing means includes a pressure ring slidably engaging an upper portion of said cylindrical member and resting on a step on the outer surface of said cylindrical member, a guiding sleeve for guiding said upper portion of said cylindrical member and a biasing spring arranged between said guiding sleeve and said pressure ring to urge said pressure ring and thus said cylindrical member into said initial position.

3. A pneumatic hammer as defined in claim 1, wherein said stationary sleeve defines control edges cooperating with the edges of said annular recess to close the connection between said inlet air conduit and said outlet air channel while opening the connection between said inlet air channel and said inlet air passage when said cylindrical member is displaced from its initial position against said biasing means.

* * * * *